US006718935B2

(12) United States Patent
Meisner et al.

(10) Patent No.: US 6,718,935 B2
(45) Date of Patent: Apr. 13, 2004

(54) HYDRAULIC FUEL SYSTEM

(75) Inventors: David B. Meisner, Carol Stream, IL (US); Griselda Collet-Santacruz, OakPark, IL (US); Ruben D. Varela, LaGrange, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 286 days.

(21) Appl. No.: 09/765,776

(22) Filed: Jan. 19, 2001

(65) Prior Publication Data

US 2002/0023624 A1 Feb. 28, 2002

Related U.S. Application Data

(60) Provisional application No. 60/177,857, filed on Jan. 24, 2000.

(51) Int. Cl.[7] ..... F01M 5/00

(52) U.S. Cl. ..... 123/196 AB; 123/446; 123/195 C; 184/106

(58) Field of Search ..... 123/446, 456, 123/447, 195 C, 196 AB, 495, 509; 184/106, 1.5

(56) References Cited

U.S. PATENT DOCUMENTS

| | | | | |
|---|---|---|---|---|
| 4,589,395 | A | | 5/1986 | Timms et al. |
| 5,168,855 | A | | 12/1992 | Stone |
| 5,191,867 | A | | 3/1993 | Glassey |
| 5,213,083 | A | | 5/1993 | Glassey |
| 5,245,970 | A | | 9/1993 | Iwaszkiewicz et al. |
| 5,465,233 | A | | 11/1995 | Slemmer |
| 5,546,912 | A | | 8/1996 | Yamada et al. |
| 5,564,391 | A | | 10/1996 | Barnes et al. |
| 5,601,067 | A | | 2/1997 | Wirbeleit et al. |
| 5,757,259 | A | * | 5/1998 | Fulford et al. ..... 336/92 |
| 5,809,963 | A | * | 9/1998 | Saito ..... 123/195 C |
| 5,839,413 | A | | 11/1998 | Krause et al. |
| 5,975,053 | A | * | 11/1999 | Rodier ..... 123/446 |
| 6,000,379 | A | * | 12/1999 | Stockner et al. ..... 123/446 |
| 6,488,003 | B2 | * | 12/2002 | Karlsson ..... 123/196 AB |
| 6,527,087 | B2 | * | 3/2003 | Ito et al. ..... 184/6.5 |

* cited by examiner

*Primary Examiner*—Carl S. Miller
(74) *Attorney, Agent, or Firm*—Susan L. Lukasik; Dennis Kelly Sullivan; Jeffrey P. Calfa

(57) ABSTRACT

There is provided a hydraulic fuel system having an integrated and internally mounted oil circuit for providing high pressure in a hydraulically operated electronically controlled fuel injector fuel system. There is provide an internally mounted high pressure pump in a pump housing in the crankcase and connected to internally routed high pressure lines that deliver the oil to high pressure oil rails. There is provide an integrated low pressure oil reservoir in the crank case that comprises a low pressure oil cooler and reservoir. The oil cooler is preferably immersed inside the low pressure oil reservoir to optimize available engine space and improve heat transfer. There is also provided a high pressure pump filter that covers a high pressure pump inlet feed passage to prevent debris from passing into the high pressure oil pump and other components on the high pressure oil circuit.

35 Claims, 11 Drawing Sheets

REAR BRANCH TUBE W/BOLT, WASHER, RUBBER & LIMITER TUBE

REAR BRANCH TUBE ASSY. INSTALLED

PUMP INLET SEAL PLACED
IN C'CASE COUNTERBORE

0 RING INSTALLED
IN PUMP DISCHARGE

DISCHARGE TUBE INSTALLED

HYDRAULIC FUEL SYSTEM

This patent application claims the benefit of Provisional U.S. Patent application Ser. No. 60/177,857 filed on Jan. 24, 2000.

FIELD OF THE INVENTION

This invention relates generally to hydraulic fuel systems for internal combustion engines. More particularly, this invention relates to hydraulic fuel systems for diesel engines with hydraulically activated electronically controlled unit injection.

BACKGROUND OF THE INVENTION

Many diesel engines use hydraulically activated electronically controlled unit injection (HEUI) fuel systems to improve engine performance. HEUI fuel systems, also referred to as hydraulic fuel systems, require high-pressure oil to operate the fuel injectors. In particular, the HEUI system employs high pressure lube oil acting on an intensifier piston in the top of each fuel injector to drive down a fuel plunger and thereby eject fuel. Existing HEUI fuel systems, typically have a high pressure lube oil circuit and a low pressure oil circuit and a high pressure oil pump cooperatively between them.

Existing HEUI fuel systems typically have various components mounted externally to the engine, and in particular to the engine crank case. The high pressure oil circuit, for example, has an externally mounted high pressure pump and externally routed high pressure oil lines that deliver high pressure oil to high pressure rails or reservoirs. Also, the low pressure oil circuit typically has a low pressure oil cooler that is also mounted externally to the engine crankcase. Further, the low pressure oil cooler and a low pressure oil reservoir, which feeds low pressure oil to the high pressure pump, are typically separate components in existing hydraulic fuel systems. The location, relative to the engine, of these various components results in a large number of components needed to provide the high pressure oil in existing HEUI fuel system. Moreover, the externally mounted nature of these components typically increases the size of the engine compartment space required by engines using the HEUI fuel system.

In addition, the externally mounted and separate component have a greater probability of developing oil leaks and adversely impacting the engine performance and the environment outside the engine. The externally mounted and separate hydraulic fuel system components also tend to lead to higher engine manufacturing time, costs and complexity due to a greater number of components being mounted to the engine.

Accordingly, there is a need for a hydraulic fuel system, which provides high pressure oil, with reduced space requirements while minimizing the impact of oil leaks in the hydraulic fuel system oil circuit.

SUMMARY OF THE INVENTION

The present invention provides a hydraulic fuel system, or hydraulically-operated electronically controlled fuel injector system, having an integrated and internally mounted oil circuit for providing appropriate high pressure required in the HEUI fuel system. There is provided an internally mounted high pressure pump connected to internally routed high pressure lines or tubes that deliver oil from the high pressure pump to high pressure oil reservoirs or rails. The high pressure pump is internally mounted in a high pressure pump housing in the crankcase and the high pressure oil lines are internal to the engine. The high pressure pump housing is positioned in a rear top portion of the crank case in the V-portion of a V-type engine. The high pressure oil lines comprise flexible tube sections and other components to reduce vibrational wear. There is also provide an integrated low pressure oil reservoir which is positioned in a front top portion of the crank case in the V-portion of the engine. The integrated low pressure oil reservoir comprises a low pressure oil cooler and a low pressure oil. The oil cooler or heat exchanger is immersed inside the low pressure oil reservoir to reduce space and improve heat transfer. The integrated low pressure reservoir also has a high pressure pump filter that covers a high pressure pump feed passage that supplies low pressure oil to the high pressure oil pump. The filter prevents debris from passing into the high pressure oil pump and other components on the high pressure oil circuit of the hydraulic fuel system.

The hydraulically-operated electronically controlled fuel injector (HEUI) system for an internal combustion engine for actuating a fuel injector comprises a controller able to receive an actuating fluid pressure measurement from an ICP sensor; an IPR valve; at least one high pressure actuating fluid reservoir; an integrated low pressure fluid reservoir; a rear gear driven high pressure pump disposed in a high pressure pump housing and operatively connected to the integrated low pressure fluid reservoir; and an internally disposed high pressure fluid line operatively connecting the high pressure pump and the at least one high pressure actuating fluid reservoir, whereby the controller selectively modifies pressure in the high pressure fluid line via selective actuation of the IPR valve to obtain a desired pressure in the at least one high pressure actuating fluid reservoir.

Additionally, the high pressure pump housing further comprises a high pressure pump cover and a high pressure pump mounting in a rear top crank case area. And, the high pressure pump housing and the integrated low pressure fluid reservoir are disposed between a first and a second cylinder head. The HEUI system also has an integrated low pressure fluid reservoir comprising a low pressure fluid cooler and a low pressure fluid housing in a front top crank case area, a high pressure pump filter and a high pressure pump feed passage connected to the high pressure pump.

The high pressure fluid line further comprises a high pressure discharge tube attached to the high pressure pump; a branch tube section attached to the high pressure discharge tube; a rigid tube section attached to the branch tube section; a flexible tube section attached to the rigid tube section; and a high pressure check valve attached between the flexible tube section and the high pressure actuating fluid reservoir.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE INVENTION

Figure 1:
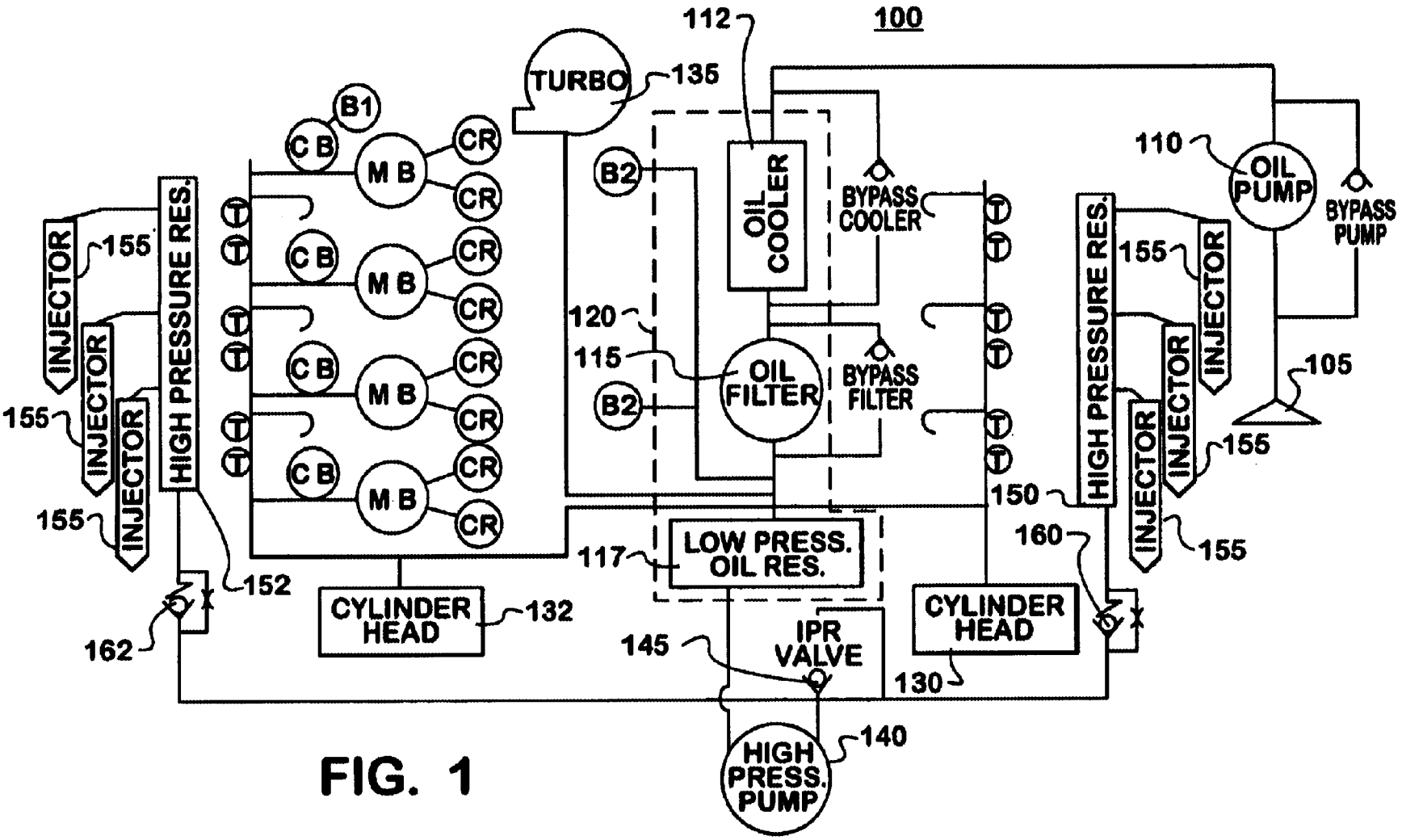
FIG. 1 shows a schematic view of a hydraulic fuel system according to the present invention.

FIG. 1 shows a schematic view of a hydraulic fuel system 100 for an internal combustion engine (not shown) according to the present invention. FIG. 1 preferably represents a diesel engine having a V-type configuration, a first and second cylinder head 130 and 132, six cylinders, and hydraulically activated electronically controlled unit fuel injection. However, those of skill in the art will readily recognize that the hydraulic fuel system 100 of the present invention may be applied to other types of internal combustion engines including ignition engines, in-line configurations, and other numbers of cylinders.

The hydraulic fuel system 100 has a low pressure oil circuit 200 (shown in FIG. 2) interconnected with a high pressure oil circuit 300 (shown in FIG. 8) to thereby deliver high pressure actuating fluid to high pressure reservoirs 150 and 152. The high pressure fluid used in FIG. 1 is preferably engine lubrication oil. However, those of skill will readily recognize that other actuation fluids may be used in the hydraulic fuel system 100. The low pressure oil circuit 200 operates at oil pressures below 100 psi, and preferably about 50 psi. The high pressure circuit 800 can operates at oil pressures up to 6,000 psi. Other oil pressures including different oil pressures for different parts of the hydraulic fuel system may be used depending on a particular engine application.

In operation, the hydraulic actuation fluid or engine oil gathers in an engine oil sump or oil pan 105. The sump 105 is preferably located at the lowest part of the engine so gravity returns used oil for further circulation through the engine and hydraulic fuel system 100. A low-pressure pump 110, e.g., a typical gerotor pump, supplies oil from the oil sump 105 through an oil cooler 112 and an oil filter 115 into a low pressure reservoir 117. In a preferred embodiment, the low pressure oil cooler 112, the oil filter 115, and the low pressure oil reservoir 117 comprise part of the integral low pressure oil reservoir 120. Although, the engine oil filter 115 is shown as part of the integrated low pressure oil reservoir 120, it 115 may also be a separately attached component. Low pressure oil can then be provided to different parts of the engine for lubrication. For example to lubricate the first and second cylinder heads 130 and 132, the turbocharger 135, and the like. Low pressure oil is also fed from the low pressure oil reservoir 117 to a typical high pressure pump 140.

The high pressure pump 140 discharges high pressure oil in a high pressure oil delivery line 143, which is operatively connected to an injection pressure regulator (IPR) valve 145 and a first and second high pressure oil reservoir 150 and 152. Typical IPR valves 145 have a mechanical relief valve section built in that operates if the electronically controlled valve fails to a closed position, thereby preventing overpressure damage to the system. In the preferred embodiment, there is a first and second check valve 160 162 between the high pressure oil line 143 and the first and second high pressure oil reservoirs 150 and 152. The high pressure oil reservoirs 150 and 152 are also typically knows as high pressure oil rails. The high pressure oil in the first and second high pressure oil reservoirs 150 and 152 is then selective and appropriately applied to the fuel injectors 155.

The delivery of high pressure oil is controller by the IPR valve 145 which is in turn controlled by a controller (not show), typically an electronic control module (ECM). The ECM appropriately operates the IPR valve 145 to open and bleed off, or dump, a portion of the high pressure oil, ultimately back to the engine oil sump 105, based upon high pressure oil measurements received from an injection control pressure (ICP) and other engine parameters. Other engine parameters can include throttle position, oil temperature, low oil pressure measurement, etc. In this manner, the ECM operates the IPR valve 145 to control pressure in the high pressure oil circuit 800 and thereby obtain or maintain a desired pressure in the high pressure line 143 and in the high pressure oil reservoirs 150 and 152.

When the ECM determines that fuel will be injected by a specific injector, based on various received engine parameter measurements or signals, the ECM will send a fuel delivery control signal to an injector drive module (not shown). The injector drive module will actuate a poppet valve (not shown) that then allows the high pressure oil from the high pressure oil reservoirs 150 and 152 to actuate an injector intensifier piston (not shown). The high pressure oil acting on the intensifier piston will actuate a fuel plunger which will increase the fuel pressure in an injector needle (not shown). When the fuel pressure is sufficient, it will lift the injector needle of its seat against its spring force (popping pressure) and thereby begin fuel injection into a corresponding combustion chamber (not shown).

Figure 2:
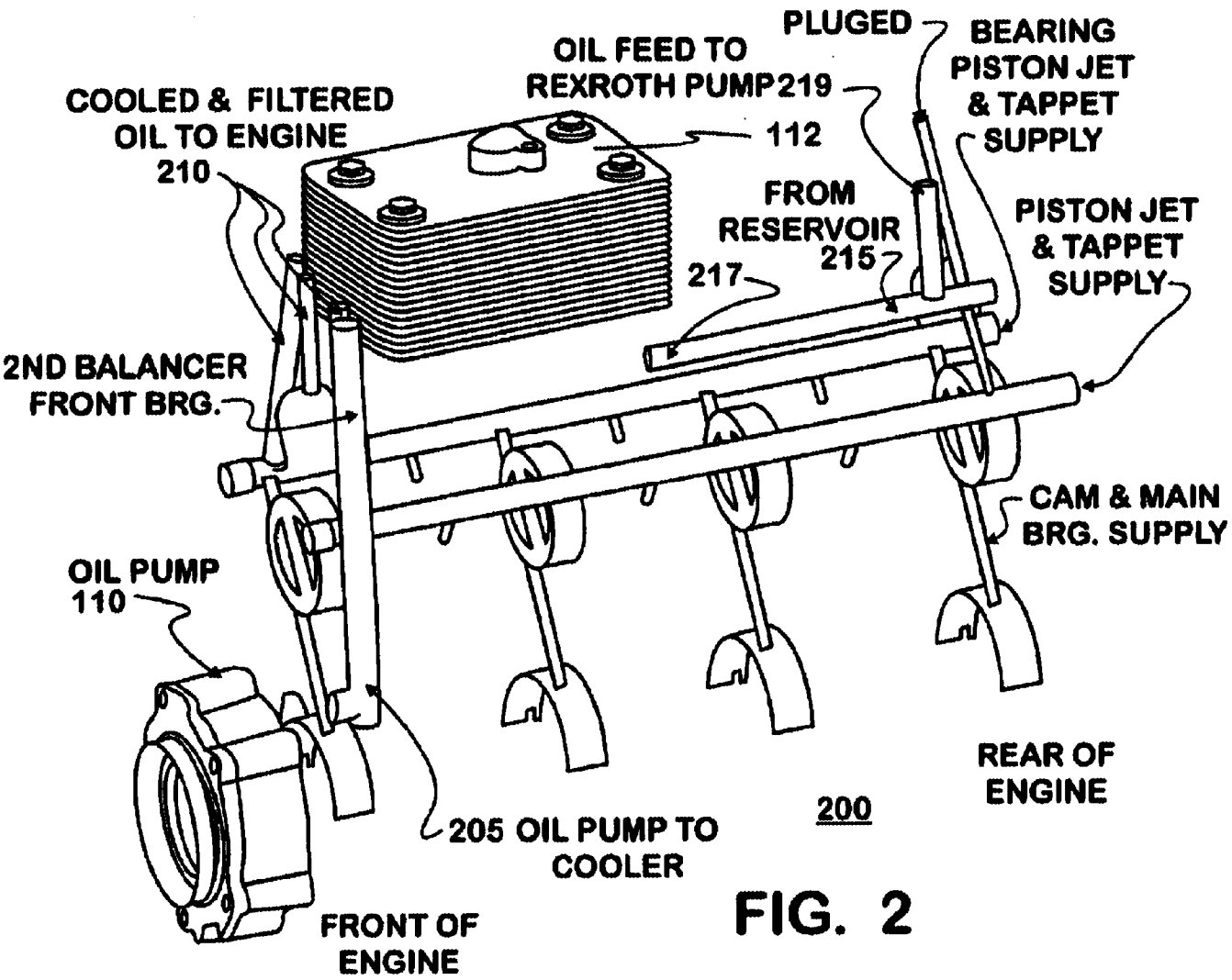
FIG. 2 shows a perspective view of a low pressure oil circuit of the hydraulic fuel system shown in FIG. 1 according to the present invention.

FIG. 2 shows a perspective view of a low pressure (LP) oil circuit 200 of the hydraulic fuel system 100 according to an embodiment of the present invention. The low pressure oil circuit 200 provides low pressure oil to the engine and to the high pressure pump 140. There is shown a low pressure oil pump or gerotor pump 110 which draws oil from the engine oil sump or oil pan 105 (shown in FIG. 1). The gerotor or oil pump 110 supplies low pressure oil to the integrated low pressure oil reservoir 120 via a low pressure pump discharge passage 205 in the crank case (not shown). The low pressure oil is pumped upward to the top of the crank case where it goes into an integrated low pressure (LP) reservoir cover 300 (shown in FIG. 3). The integrated LP reservoir cover 300 is preferably made of cast aluminum, though other materials may be substituted, and preferably also holds a low pressure oil cooler 112. The oil then passes through the low pressure oil cooler 112 and into and out of onto a oil filter assembly 115 (shown in FIG. 1). The low pressure oil cooler 112 is situated under the integrated LP reservoir cover 300 and is disposed in a low pressure reservoir 117 (shown in FIGS. 1 and 4). Thus, the low pressure oil cooler 112 is surrounded by the oil in the low pressure reservoir 117.

The low pressure oil then goes on to lubricate the engine via appropriate passages 210 in the crank case, and to fill the low pressure oil reservoir 117 that is formed in the top front area 410 of the crank case. There is also shown a high pressure pump feed passage 215 that feeds low pressure oil via the low pressure oil reservoir 117 to the high pressure pump 140. The high pressure pump feed passage 215 is preferably comprised of a horizontal passage 217 in the crank case and a vertical passage 219 (also shown in FIGS. 13 and 14) in a rear top portion 1305 (shown in FIG. 13) of the crank case that connects to a pressure pump inlet (not shown).

In a preferred embodiment, the integral low pressure oil reservoir 120 comprises the low pressure oil cooler 112 and the low pressure oil reservoir 117. The integrated low pressure oil reservoir 120 can further comprise the high pressure pump feed passage 215 and a high pressure pump filter 420 (shown in FIG. 4). Also, the engine oil filter 115 can be part of the integrated low pressure oil reservoir 120 or it 115 may be a separately component that cooperatively attached to the integrated LP oil reservoir 120.

Figure 3:
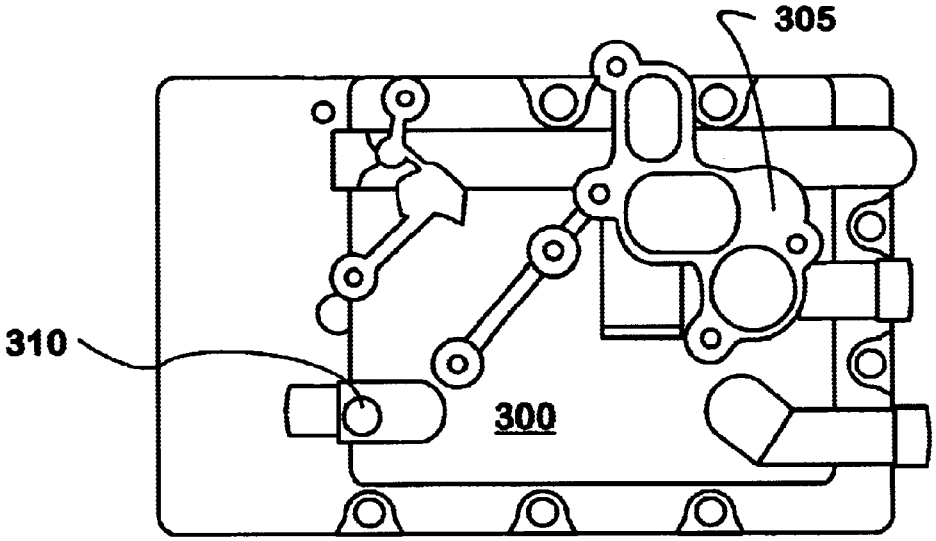
FIG. 3 shows a top view of an integrated low pressure reservoir cover mounted on a top front portion of a crank case according to the present invention.

FIG. 3 shows a top view of the integrated low pressure reservoir cover 300 mounted on a top front portion 410 (shown in FIG. 4) of a crank case and thereby enclosing the low pressure oil cooler 117 (shown in FIG. 4) to form the integrated low pressure oil cooler 120 that is part of the low pressure circuit 200. Moreover, the integrated low pressure oil cooler cover 300 can further comprise a bypass valve configuration 305 and EGR tube configuration 310.

Figure 4:
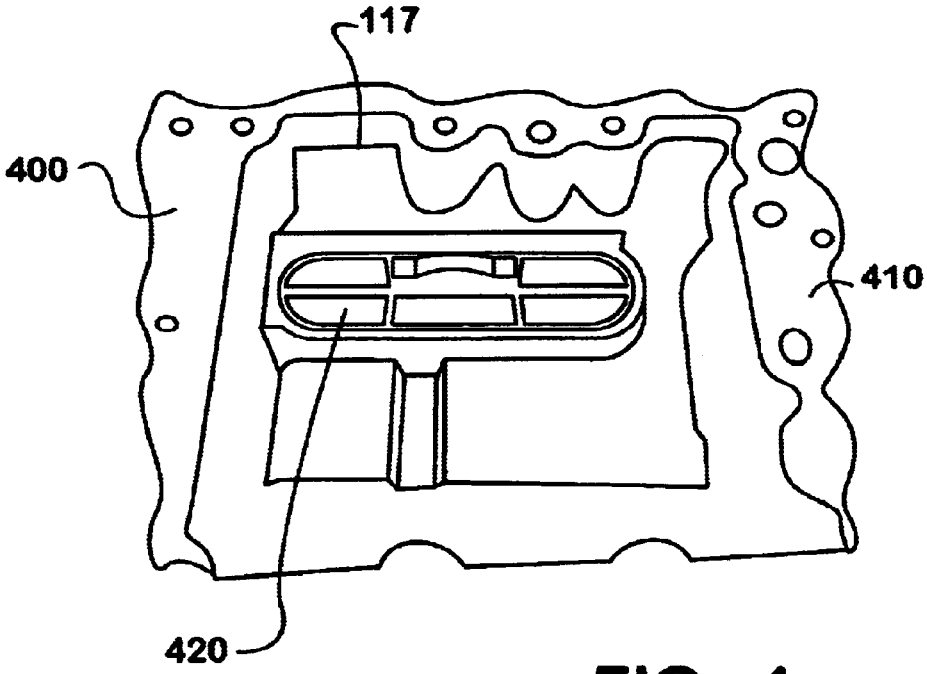
FIG. 4 shows a perspective view of a low pressure oil reservoir in the front top portion of the crank case with an installed high pressure pump screen filter according to the present invention.

FIG. 4 shows a perspective view of the low pressure oil reservoir 117 preferably formed as part of the crank case and situated in the front top 410 portion of the crank case. In addition, when the hydraulic fuel system of the present invention is used in a V-type engine application, the low pressure oil reservoir 117 is preferably situated in the middle V-configuration between the first and second cylinder head mountings 1310 and 1320 on the crank case (shown in FIG. 13). During engine start up, before the system develops pressure, the low pressure reservoir 117 provides a gravity feed to the high pressure pump 140 through a screen filter 420. Once the engine is in operation, the low pressure oil reservoir 117 is at lube pressure system (approximately in the range of 15 to 50 psi depending on engine speed). This lube pressure maintains a low pressure oil feed to the high pressure pump 140 during engine operation. Further, the low pressure reservoir 117 provides oil that will keep the high pressure rails 150 and 152 filled when the engine is not operating, since oil will cool and contract in the high pressure rails 150 and 152 rails and causes a void if not replenished. The oil from the low pressure reservoir 117 is fed by gravity from the reservoir to the high pressure reservoirs 150 and 152 through a check valve (not shown) in the high pressure pump 140, that is seated (closed) when the engine and pump are in operation.

FIG. 4 further shows a high pressure pump filter 420 that filters the low pressure oil in the bottom of the low pressure oil reservoir 117. The high pressure pump filter 420 prevents debris from entering the high pressure pump passage 215 (shown in FIG. 2) which could lead to malfunction of components in the high pressure oil circuit 800 (shown in FIG. 8). The high pressure pump filter 420 is preferably a screen type filter, or strainer filter of at least 150 microns in size.

Figure 5:
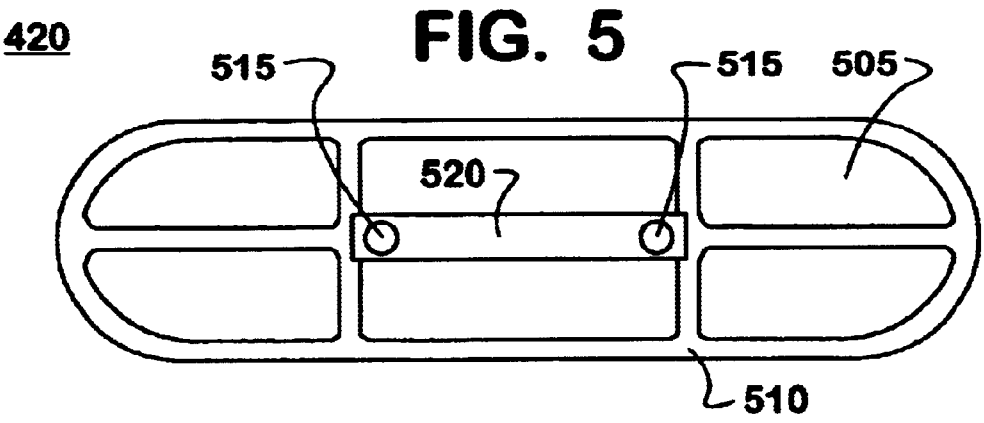
FIG. 5 shows a top view of the high pressure pump filter shown in FIG. 4.

FIG. 5 shows a top view of the high pressure pump filter 420 shown mounted inside and at the bottom of the low pressure reservoir 117 shown in FIG. 4. Low presure oil is fed from the low pressure reservoir 117 through the screen filter 420, which prevents debris from flowing into the high pressure pump feed passage 215. The filter screen 420 has a support frame 510 forming several openings for the low pressure oil to pass. While six openings are shown, one or other numbers of openings may be used. Each opening is covered by mesh 505, which is sized to collect debris that may damage the high pressure oil circuit 800 of the hydraulic fuel system 100 while minimizing the pressure drop across the filter 420. The high pressure pump filter 420 is preferably a 150 micron screen type filter. However, those of skill in the art will recognize that filter 420 could also be large than 150 micron screen filter depending on particular engine applications, e.g., a larger screen filter for engine cold starting. Also, the support frame and mesh are made of plastic although other suitable materials may be used.

A rubber handle bumper 520 is connected to the support frame 510 by posts 515. When assembled, low pressure oil cooler 112 of the integrated low pressure oil reservoir 120 presses against the rubber handle bumper 520, which operatively flexes or contracts to hold the screen filter 420 in place. The screen filter 420 may also be used without the rubber bumper 520, in which case the oil flow would keep the screen filter 420 in place. The rubber handle bumper 520 is preferably made rubber or other elastomeric material.

Figure 6:
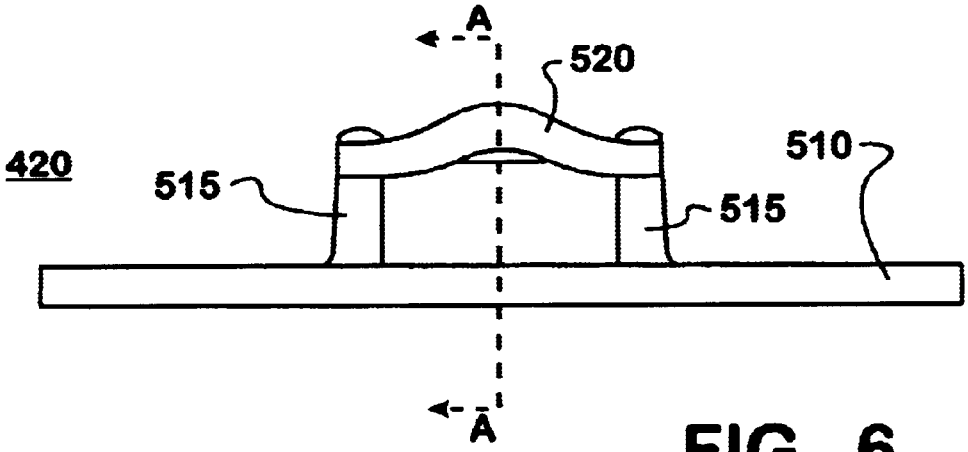
FIGS. 6 shows a front view of the high pressure pump filter shown in FIG. 5.
Figure 7:
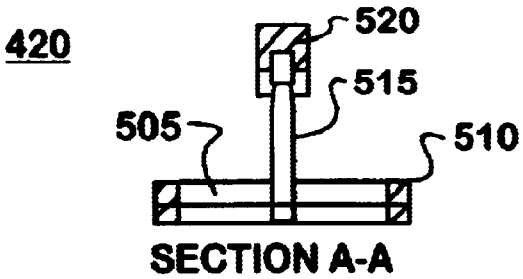
FIG. 7 shows a section end view of the high pressure pump filter along the section line A—A shown in FIG. 6.

FIGS. 6 shows a front view of the high pressure pump screen filter 420 shown in FIG. 5. FIG. 7 shows a section end view of the high pressure pump filter 420 along the section line A—A shown in FIG. 6.

Figure 8:
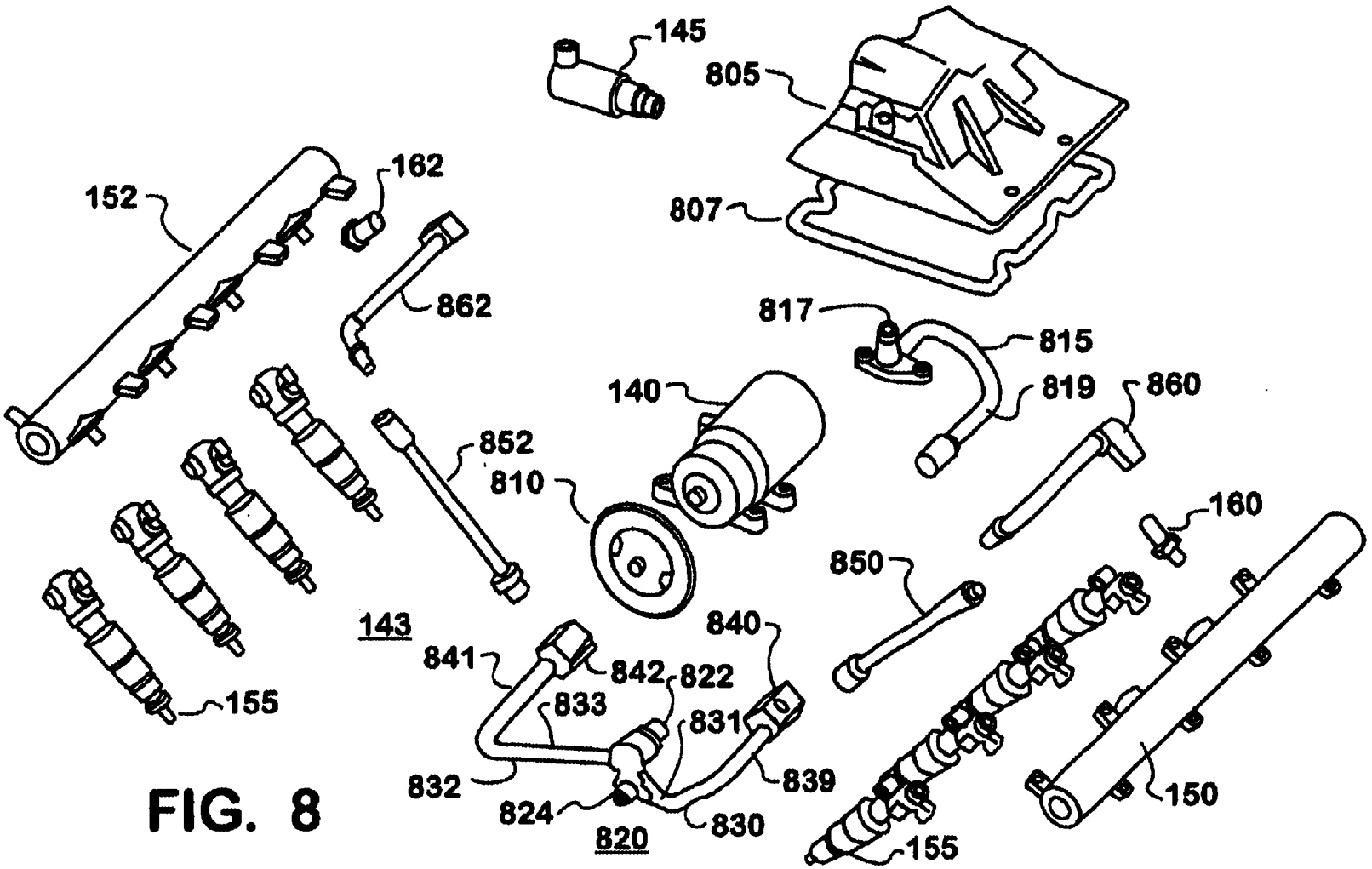
FIG. 8 shows a perspective and exploded view of a high pressure oil circuit of the hydraulic fuel system shown in FIG. 1 according to the present invention.

FIG. 8 shows a perspective and exploded view of a high pressure oil circuit 800 of the hydraulically-operated electronically controlled fuel injector system 100, or hydraulic fuel system, shown in FIG. 1. Generally, a controller or ECM, after receiving and processing a pressure measurement in the high pressure oil line 143 from an injection control pressure (ICP) sensor (not shown). The ECM will then selectively modify pressure in the high pressure oil circuit 800 via selective actuation of an IPR valve 145 to obtain a desired pressure in the high pressure oil circuit 800. The ICP sensor is preferably mounted adjacent to the IPR valve 145 to monitor the high pressure line 143 oil pressure. The high pressure pump 140 and IPR valve 145 will cooperatively maintain appropriate high oil pressures in the high pressure oil reservoirs 150 and 152. The IPR valve typical working pressure is about 28 Mpa or 4060 psi. The high pressure oil circuit 800 provides high pressure actuating fluid, or high pressure oil, to the high pressure oil reservoirs 150 and 152 which in turn appropriately interact with the unit injectors 155 to inject fuel into a corresponding combustion chamber via appropriate actuation from a controller, for example an electronic control module (ECM) or microprocessor (not shown). The operation of the high pressure oil circuit 800 is described in FIG. 1.

FIG. 8 shows a high pressure oil circuit comprised of a plurality of fuel injectors 155 operatively connected to a first and second high pressure oil reservoir 150 and 152. There is a first and second check valve 160 and 162 operatively connected between the first and second high pressure reservoirs 150 and 152 and a high pressure oil line 143. The high pressure oil line 143 is connected to the high pressure pump 140. There is also shown a high pressure pump cover 805 and pump cover seal 807 which will enclose the high pressure pump 140 in a high pressure pump housing 1300 (show in FIG. 13) located in a top rear portion 1305 (shown in FIG. 13) of the crank case. Also shown is a high pressure pump actuation gear 810 that drives the high pressure pump 140. The high pressure pump 810 is connected to a rear gear assembly 1505 (shown in FIG. 15) that will drive the high pressure pump 140.

FIG. 8 also shows that the high pressure oil line 143 is preferably comprised of a high pressure discharge tube 815 that attaches to the high pressure pump 140, a branch tube section 820 that attaches to the high pressure discharge tube 815, a first and second rigid tube section 850 and 852 that attaches to the branch tube section 820, a first and second flexible tube section 860 and 862 that attaches to a corresponding first and rigid tube section 850 and 852, and a first and second high pressure check valve 160 and 162 that respectively is attaches between corresponding first and second flexible tube sections 860 and 862 and the respective high pressure actuating oil reservoirs 150 and 152.

The high pressure discharge tube 815 is further preferably comprised of an injection pressure regulator (IPR) valve tube section 817 and a high pressure discharge tube section 819. Also, the branch discharge tube 820 further comprises a branch section 822, a tube support section 824, a first branch 830 attached to the branch section 822 at a first branch end 831 and having a first branch coupler 840 attached to a first branch distal end 839 and able to receive the first rigid tube section 850. The branch discharge tube 820 further comprises a second branch 832 attached to the branch section 822 at a second branch end 833 and having a second branch coupler 842 attached to a second branch distal end 841 and able to receive the second rigid tube section 852.

The high pressure oil line 143 has been described as preferably comprised of various interconnected component tubes, passages, sections and couplers. However, those of skill in the art will recognize that the high pressure oil line 143 could be comprised of more or less parts having rigid or flexible configurations. Also, the high pressure oil line 143 is preferably comprised of a plurality of sections that used snap fittings or threaded connections to connect to each other. However, other means can be used to connect the various sections, for example brazing or welding sections together.

Furthermore, the various first and second components comprising the high pressure oil circuit 800 are described because the preferred embodiment relates to a diesel engine which has a first and second cylinder head 1310 and 1320 mounting on the crank case (shown in FIG. 13) in a V-type configuration. This requires that the high pressure oil line 143 be split to feed the first and second high pressure oil reservoirs 150 and 152 in the cylinder heads 130 and 132 (not shown). Those of skill in the art, however, will readily recognize that other engine configurations would result in a modified high pressure line 143. The high pressure reservoirs 150 provide oil through a check valve 160 to a fuel injector 155 for each cylinder (not shown). Further, while first and second check valves 160 and 162 are shown, other devices may used to control the creation Helmholtz resonance of pressure waves.

Figure 9:
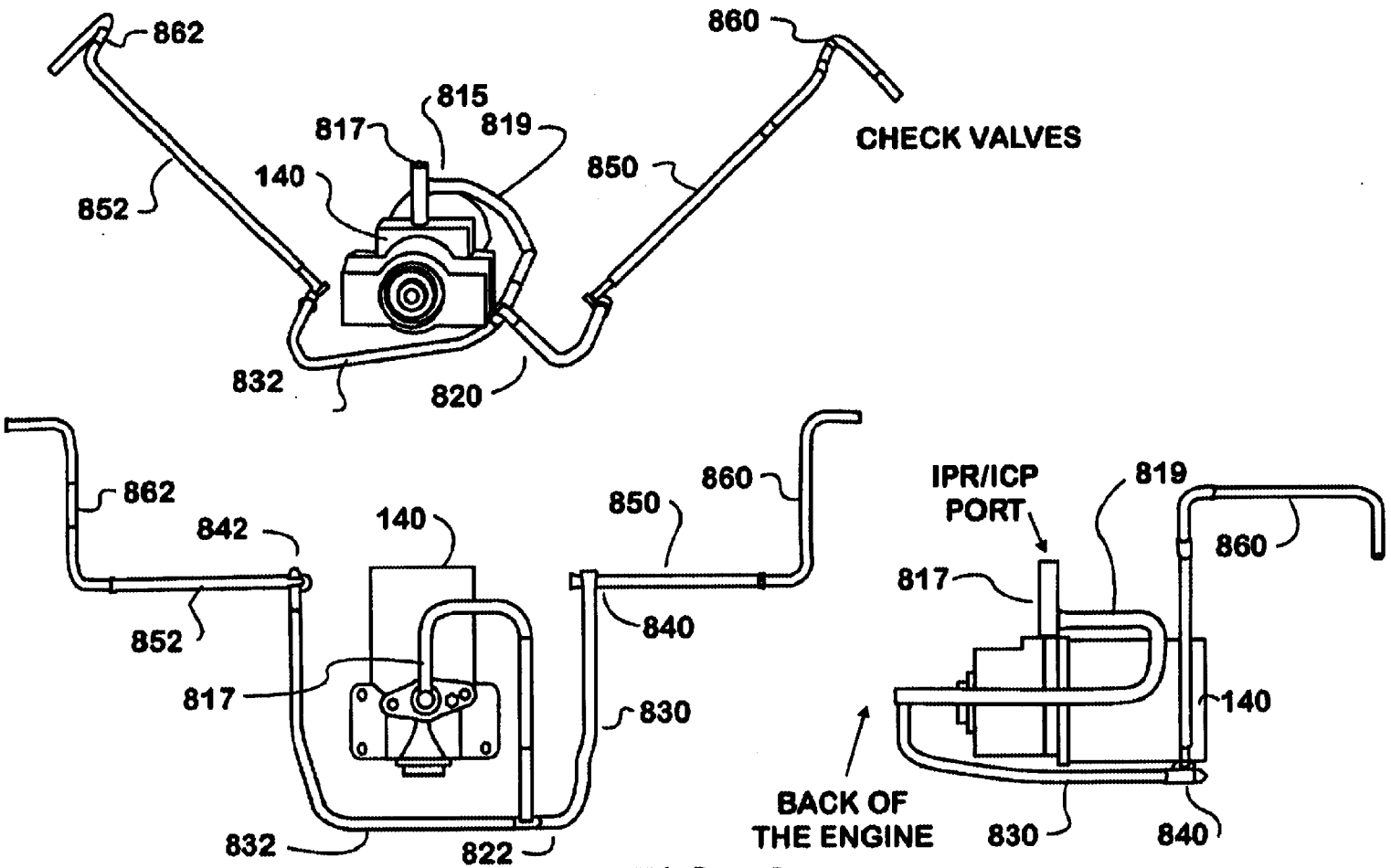
FIG. 9 shows rear, top and side perspective views of an operatively connected high pressure pump and a high pressure oil line assembly of the high pressure oil circuit shown in FIG. 8 according to the present invention.

FIG. 9 shows rear, top and side perspective views of an operatively connected high pressure pump 140 and a high pressure oil line or assembly 143 of the high pressure oil circuit 800 shown in FIG. 8. There is shown a high pressure pump 140 which is preferably disposed in a high pressure pump housing 1300 (show in FIG. 13) located in a top rear portion 1305 (shown in FIG. 13) of the crank case. A high pressure discharge tube 815 attaches to the high pressure pump 140. The high pressure discharge tube 815 is further preferably comprised of an injection pressure regulator (IPR) valve tube section or IPR port 817 and a high pressure discharge tube section 819. The discharge tube section 819 is preferably configured to travel around and down from the high pressure pump 140 and then toward the rear of the high pressure pump 140 (also shown in FIG. 17).

Figure 17:
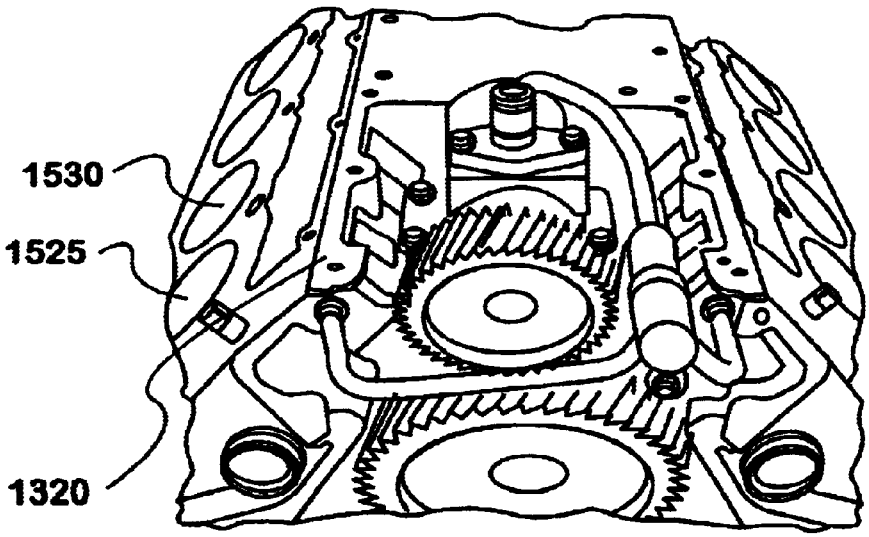
FIG. 17 shows a perspective view of the high pressure pump operatively connected to the high pressure oil line shown in FIG. 15 according to the present invention.

The high pressure discharge tube section 819 then cooperatively attaches to the branch section 822 of the branch tube 820 of the high pressure oil line 143 towards the rear of the crank case (shown in FIG. 17). The branch discharge tube 820 also comprises a tube support section 824 (shown in FIG. 12), a first branch 830 attached between the branch section 822 and a first branch coupler 840. The first branch 830 is preferably configured to travel internally in the crank case into a first cylinder head mounting 1310 (shown in FIG. 13). The first branch 830 preferably travels internally in the first cylinder head mounting 1310 to a point between two rear right piston bores 1325 and 1330 (shown in FIG. 13). The first branch coupler 840 (also shown in FIG. 13) is attached to the crank case, preferably via a bolt, and configured to receive the first rigid tube section 850.

The first rigid tube section 850 then preferably travels, still internally, up through the first cylinder head mounting 1310 (shown in FIG. 13), through a first cylinder head 130 (not physically shown), through a first rocker carrier (not shown) and then attaches to a first flexible a first flexible tube section 860. The first flexible tube section 860 is then connected to a first high pressure check valve 160 (shown in FIG. 1) that respectively attaches this side of the high pressure oil line 143 to the a corresponding high pressure actuating oil reservoir 150 (shown in FIGS. 1 and 8).

The branch discharge tube 820 also comprises a second branch 832 attached between the branch section 822 and a second branch coupler 842. The second branch 832 is preferably configured to also travel internally in the crank case into a second cylinder head mounting 1320 (shown in FIGS. 13, 15 and 17). The second branch 832 preferably travels internally in the second cylinder head mounting 1320 to a point between the two rear left piston bores 1525 and 1530 (shown in FIG. 15). The second branch coupler 842 (shown in FIG. 13) is attached to the crank case, preferably via a bolt (not shown), and configured to receive the second rigid tube section 852.

The second rigid tube section 852 then preferably travels, internally, up through the second cylinder head mounting 1310 (shown in FIGS. 13, 15, and 17), through the second cylinder head 132 (not physically shown), through a second rocker carrier (not shown) and then attaches to a second flexible tube section 862. The second flexible tube section 862 is then connected to the second high pressure check valve 162 (shown in FIG. 1) that respectively attaches this second side of the high pressure oil line 143 to the a corresponding high pressure actuating oil reservoir 152 (shown in FIGS. 1 and 8).

Thus, the high pressure oil assembly 143 preferably internally conveys or delivers high pressure oil from the high pressure pump 140, cooperatively with the IPR valve 145 to the first and second high pressure oil reservoirs 150 and 152 (shown in FIGS. 1 and 8). The high pressure oil line 143 is preferably made from light weight steel material, although other suitable materials may be used. As mentioned previously, the high pressure oil line 143 is internal to the engine, and more specifically to the crank case cylinder head mountings 1310 and 1320 and cylinder heads 130 and 132. This will reduce the space required by the high pressure oil circuit 800 and keep substantially all high pressure oil leaks inside the engine. In addition, the flexible tube sections 860 and 862 preferably reduce vibrational wear of the high pressure oil line 143 encountered during normal engine operation. The flexible sections are preferably made of wire reinforced hose although any suitable material may be used. To further reduce vibrational wear, the high pressure line 143 further uses elastomeric isolators, or rubber grommets 1205 (shown in FIG. 12) and other vibration control connections to the crank case.

Figure 10A:
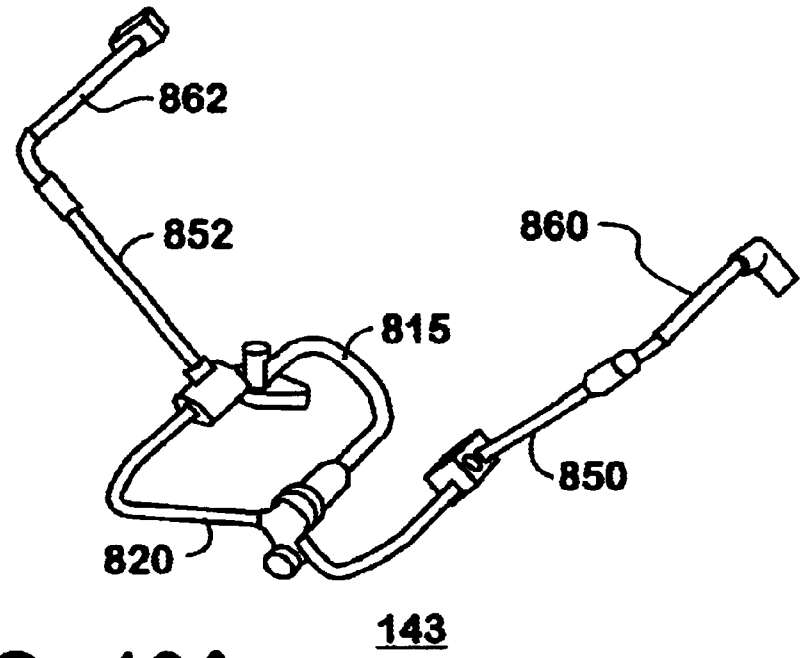
FIG. 10A shows a perspective view of the high pressure oil line assembly shown in FIG. 9 according to the present invention.
Figure 10B:
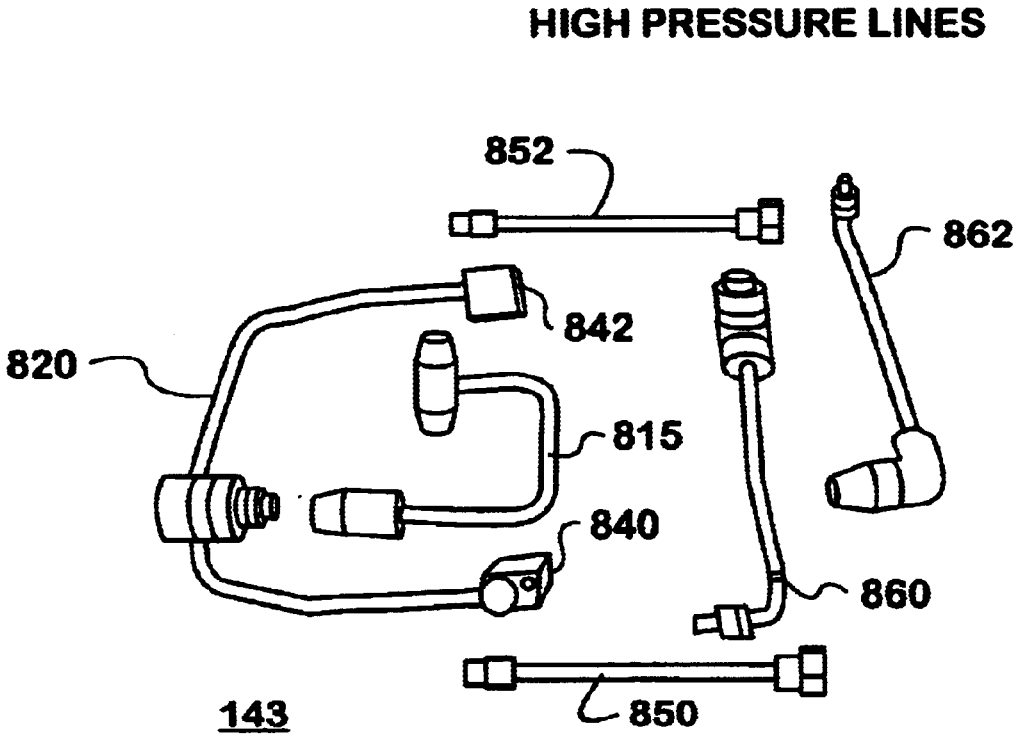
FIG. 10B shows a perspective view of various component lines comprising the high pressure oil line assembly shown in FIG. 10A.

FIG. 10A shows a perspective view of the high pressure oil line 143 as preferably assembled and shown without the high pressure pump of FIG. 9. FIG. 10B shows a perspective view of the various high pressure oil line component or sections preferably comprising the high pressure oil line 143 assembly shown in FIG. 10A. There is shown a high pressure discharge tube 815, a branch tube section 820 that attaches to the high pressure discharge tube 815 with a first and second branch coupler 840 and 842, a first and second rigid tube section 850 and 852 that attaches to the first and second branch couplers 840 and 842, a first and second flexible tube section 860 and 862 that attaches to a corresponding first and rigid tube section 850 and 852.

Figure 11A:
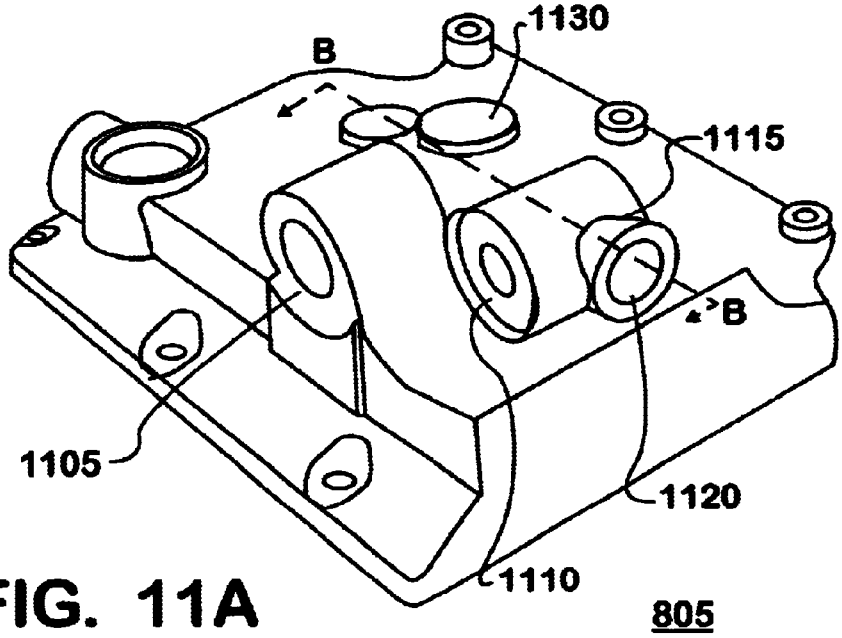
FIG. 11A shows a perspective view of a high pressure pump cover shown in FIG. 8 according to the present invention.
Figure 11B:
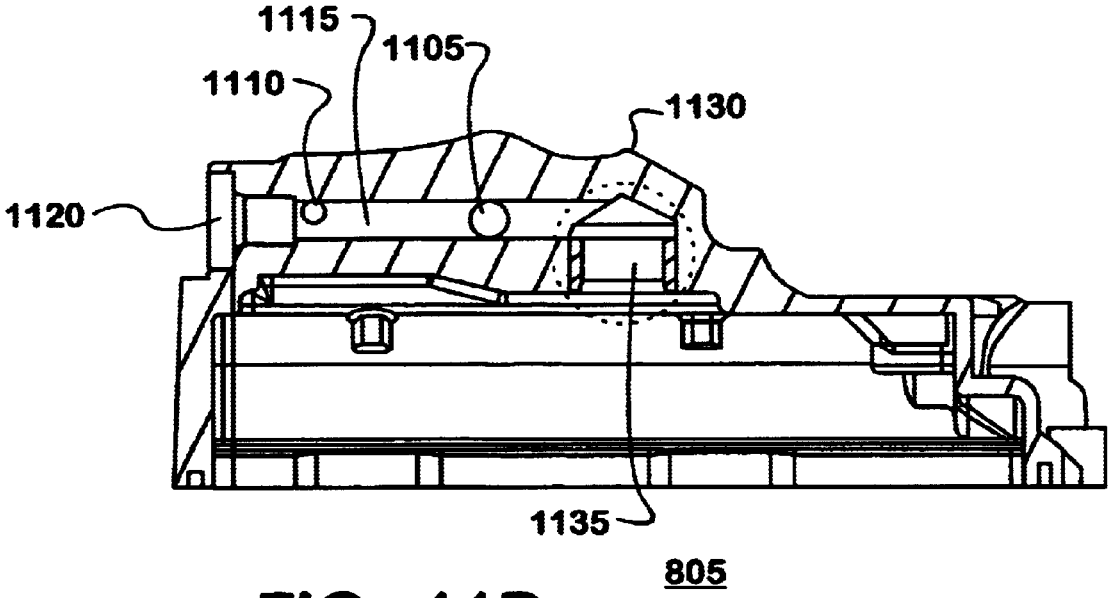
FIG. 11B shows a section view of the high pressure pump cover along the section line B—B shown in FIG. 11A.

FIG. 11 shows a perspective view of the high pressure pump cover 805 shown in FIG. 8 according to the present invention. FIG. 1B further shows a section view of the high pressure pump cover along the section line B—B shown in FIG. 11A. In a preferred embodiment, the high pressure pump 805 comprises an IPR valve mounting 1105 configured to accept the IPR valve 145 (show in FIG. 8) and an ICP mounting 1110 able to accept and injection control pressure (ICP) sensor (not shown). The high pressure pump cover further 805 comprises a pump cover fluid passage 1115 with one end 1120 shown capped of. The high pressure fluid passage 1115 that preferably extends horizontally back toward a center area 1130 of the high pressure pump cover 805. The IPR valve mounting 1105 and ICP mountings 1110 cooperatively connect with the high pressure fluid passage 1115. At the center area 1130 the high pressure fluid passage 1115 turns and travels downward in a vertical direction where it will have a second high pressure fluid passage 1115 opening 1135. The second pump cover 805 opening 1135 will cooperatively accept an injection pressure regulator (IPR) valve tube section, or IPR port 817, which contains high pressure oil and is part of the high pressure discharge tube 815 in the high pressure oil line 143 (shown in FIG. 8).

Figure 12:
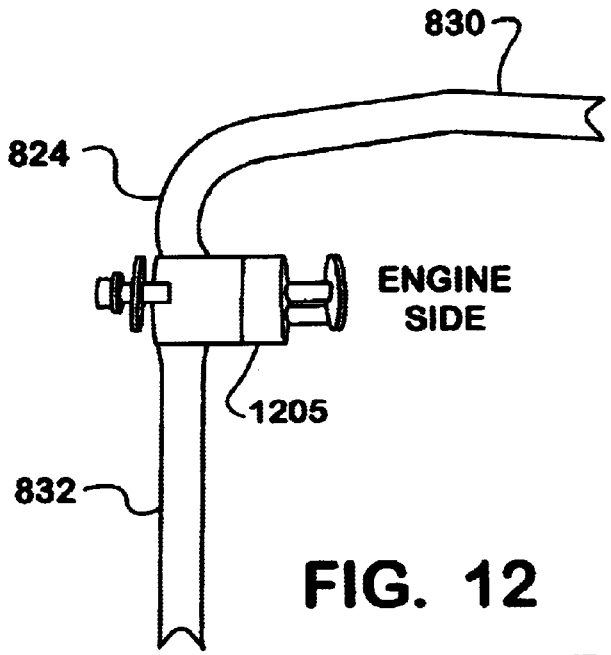
FIG. 12 shows a perspective bottom view of a rear branch tube for the hydraulic fuel system shown in FIG. 9.

FIG. 12 shows a perspective bottom view of the tube support section 824 (also show in FIG. 8) which is preferably attached to the underside of the branch section 822 of the branch tube 820 (shown in FIG. 8). The tube support section 824 is preferably located between the first and second branch 830 and 832. The tube support section 824 is preferably a metal and rubber combination configured to support the high pressure oil line 143 to the crank case, to provide some "give" for tolerances between parts in the crank case, and to reduce vibrational wear of the high pressure oil circuit 800 during engine operation. The rubber portion 1205 of the tube support section 824 is preferably an elastomeric isolator, or rubber grommet, or other vibration control connection to the crank case.

Figure 13:
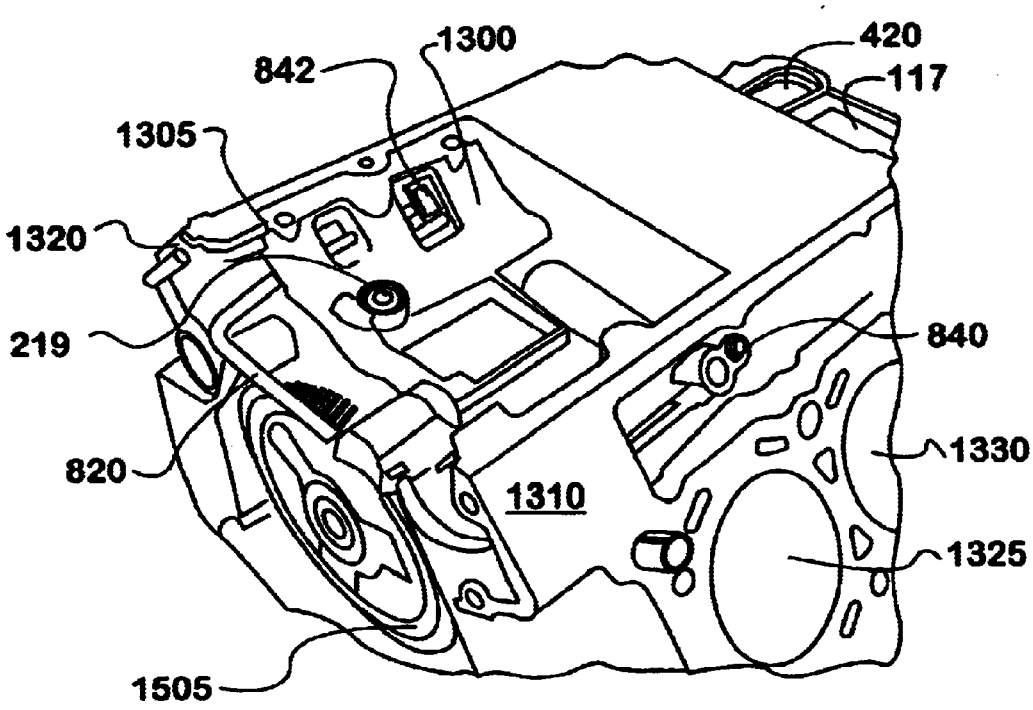
FIG. 13 shows a perspective view of a high pressure pump housing, and a portion of the high pressure line assembly of FIG. 10A installed in a rear portion of a crack case according to the present invention.

FIG. 13 shows a perspective view of the internal high pressure pump housing 1300 in the rear portion 1305 of the crack case. The high pressure pump mounting 1300 is preferably located between a first and second cylinder head 1310 and 1320 mounting on the crank case in an engine with a V-type configuration. A high pressure pump cover 805 (shown in FIGS. 11A & B) will operatively cover the high pressure pump 140 which will be disposed in the high pressure pump housing 1300 located in a top rear portion 1305 (shown in FIG. 13) of the crank case.

There is also shown a branch tube section 820 of the high pressure line 143 installed in the first and second cylinder head 1310 and 1320 mountings. The first and second branches 830 and 832 preferably travel internally in the first and second cylinder head mountings 1310 and 1320 to a point between two rear right and left piston bores 1325 & 1330, and 1525 & 1530 (shown in FIG. 15). There is also shown the first and second branch couplers 840 and 842 attached to the crank case, preferably via a bolt, and configured to receive the first and second rigid tube sections 850 and 852. When attached, the first and second rigid tube sections 850 and 852 (shown in FIG. 9) travel internally up through the first and second cylinder head mountings 1310 and 1320, through the first and second cylinder heads 130 and 132 (not physically shown), through a first and second rocker carrier (not shown) and then attaches to a first and second flexible tube section 860 and 862.

Figure 14:
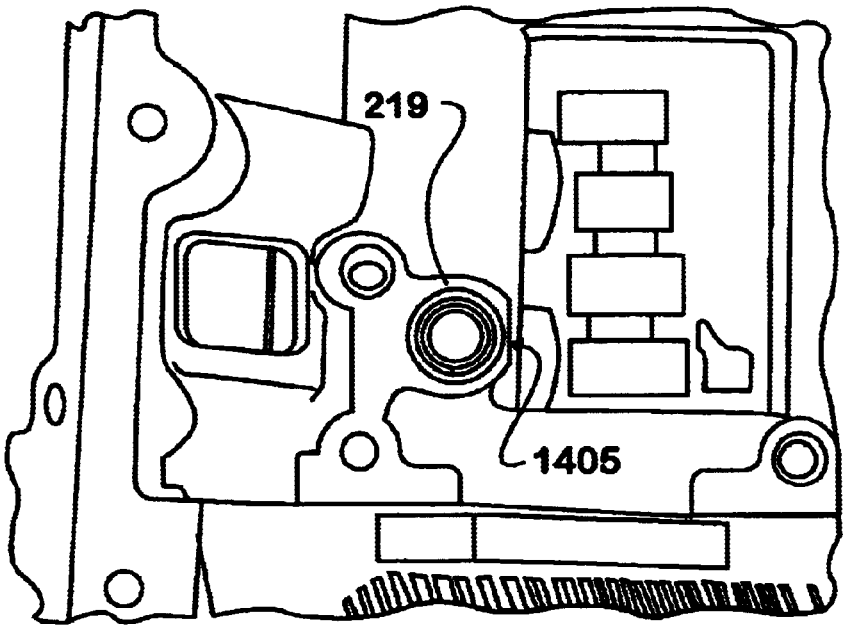
FIG. 14 shows a top view of a high pressure pump inlet seal in the high pressure pump housing shown in FIG. 13 according to the present invention.

There is also partially shown the low pressure oil reservoir 117 (shown in FIG. 4) preferably formed as part of the crank case and situated in the front top 410 portion of the crank case (shown in FIG. 4), as well as the high pressure pump filter 420 that filters the low pressure oil that enters the high pressure pump feed passage 215 (shown in FIG. 2). Last, there is shown the vertical passage 219 that feeds low pressure oil to the high pressure pump 140, and a crank case rear gear assembly 1505 (also shown in FIG. 15) that will drive the high pressure pump 140. FIG. 14 shows close-up top view of a high pressure pump inlet seal 1405 in the vertical passage 219 that feeds low pressure oil to the high pressure pump 140.

Figure 15:
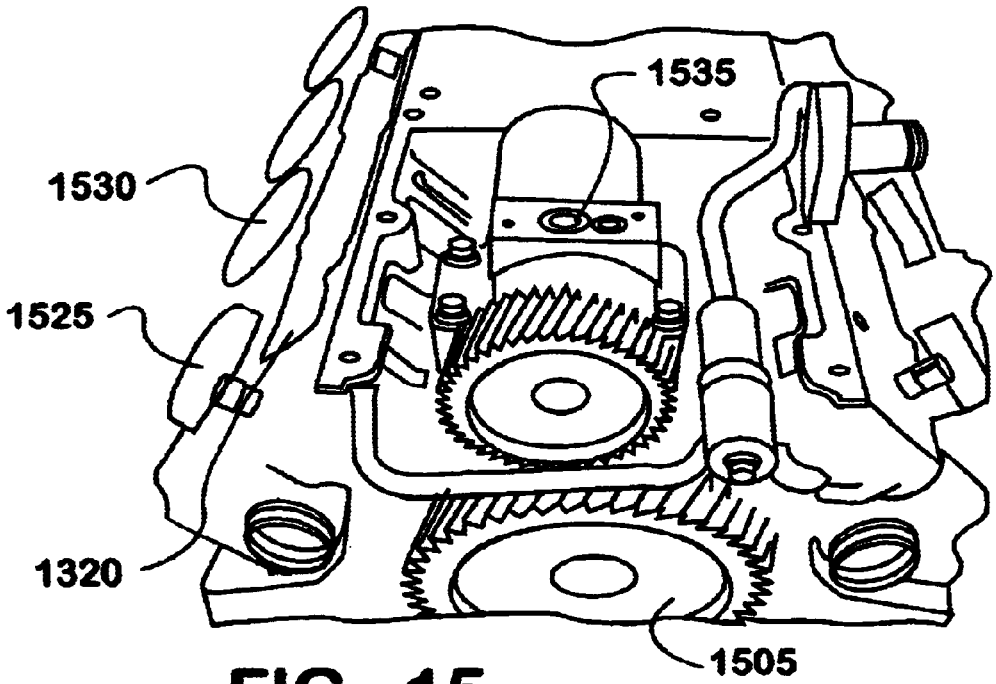
FIG. 15 shows a rear perspective view of the high pressure pump installed in the high pressure pump housing show in FIG. 13.

FIG. 15 shows a perspective view of the high pressure pump 140 installed in the high pressure pump housing 1300 in the rear top portion 1305 of the crank case shown in FIG. 13. There is also shown a high pressure discharge tube 815 attached to the branch tube section 820 of the high pressure line 143 which is installed in the first and second cylinder head 1310 and 1320 mountings (described in FIG. 13). The high pressure discharge tube 815 will be attached to a top portion 1535 of the high pressure pump 140 (shown in FIG. 17). The arrangement of the high pressure discharge tube 815 shows that the high pressure discharge pump 140 can be easily removed and installed without dismantling the high pressure line 143. This is the case since the high pressure discharge tube 815 can rotate away and toward the high pressure pump 140 as necessary.

Figure 16:
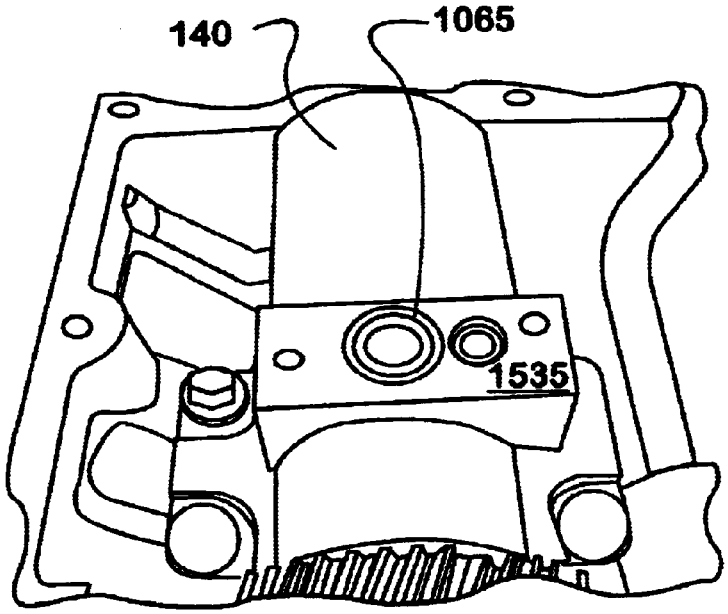
FIG. 16 shows a perspective view of an O-ring discharge seal for the high pressure pump shown in FIG. 15 according to the present invention.

There is also shown more clearly the branch tube section 820 of the high pressure line 143 installed in the second cylinder head 1320 mountings. The second branch 832 preferably travels internally in the second cylinder head mounting 1320 to a point between two rear left piston bores 1525 and 1530. FIG. 15 also shows a high pressure pump actuation gear 810 that drives the high pressure pump 140, and the rear gear assembly 1505 which in turn drives the high pressure pump rear gear 810. FIG. 16 shows a close up view of the an O-ring discharge seal 1605 in the top portion 1535 of the high pressure pump shown in FIG. 15.

FIG. 17 shows a perspective view of the high pressure pump 140 installed in the high pressure pump housing 1300 in the rear top portion 1305 of the crank case shown in FIG. 15. There is also shown a high pressure discharge tube 815 operatively attached to the high pressure discharge tube 815 and the branch tube section 820 of the high pressure line 143. There is shown the IPR valve tube section or port 817 which is part of the high pressure discharge tube 815. Also, the branch tube section 820 of the high pressure line 143 installed in the second cylinder head 1320 mounting is more clearly shown. The second branch 832 preferably travels internally in the second cylinder head mounting 1320 to a point between two rear left piston bores 1525 and 1530. Last, FIG. 17 shows the operatively connected high pressure pump actuation gear 810 and rear gear assembly 1505.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

We claim:

1. A hydraulically-operated electronically controlled fuel injector system for an internal combustion engine for actuating a fuel injector, the system comprising:

a controller able to receive an actuating fluid pressure measurement from an ICP sensor;

an IPR valve;

at least one high pressure actuating fluid reservoir;

an integrated low pressure fluid reservoir comprising a low pressure fluid cooler and a low pressure fluid housing in a first area of a crank case of the internal combustion engine;

a high pressure pump disposed in a high pressure pump housing and operatively connected to the integrated low pressure fluid reservoir, wherein the high pressure pump housing comprises a high pressure pump cover and a high pressure pump mounting in a second area of the crank case; and an internally disposed high pressure fluid line operatively connecting the high pressure pump and the at least one high pressure actuating fluid reservoir;

wherein the controller selectively modifies pressure in the high pressure fluid line via selective actuation of the IPR valve to obtain a desired pressure in the at least one high pressure actuating fluid reservoir.

2. The system of claim 1, wherein the first area of the crank case is a front top crank case area.

3. The system of claim 1, wherein the second area of the crank case is a rear top crank case area.

4. The system of claim 3, wherein the high pressure pump housing and the integrated low pressure fluid reservoirs are disposed between a first and a second cylinder head.

5. The system of claim 4, wherein the high pressure fluid line comprises:

a high pressure discharge tube attached to the high pressure pump;

a branch tube section attached to the high pressure discharge tube;

a rigid tube section attached to the branch tube section;

a flexible tube section attached to the rigid tube section;

a high pressure check valve attached between the flexible tube section and the high pressure actuating fluid reservoir.

6. The system of claim 4, wherein the Integrated low pressure fluid reservoir further comprises:

a high pressure pump filter; and a high pressure pump feed passage connected to the high pressure pump.

7. The system of claim 6, wherein the high pressure pump feed passage is in the crank case and is comprised of a horizontal low pressure fluid passage connecting to a vertical pump Inlet passage.

8. The system of claim 4, wherein the high pressure pump cover comprises:

an IPR valve mounting configured to accept the IPR valve;

an ICP mounting able to accept the ICP sensor; and a pump cover fluid passage cooperatively attached to the high pressure fluid line and connected to the IPR valve mounting and the ICP mounting.

9. The system of claim 5, wherein the high pressure discharge tube comprises:

an IPR valve tube section, and a high pressure discharge tube section;

and wherein the branch discharge tube comprises a branch section, a first branch attached to the branch section at a first branch end, a first branch coupler attached to a first branch distal end and able to receive a first rigid tube section, a second branch attached to the branch section at a second branch end, a second branch coupler attached to a second branch distal end and able to receive a second rigid tube section.

10. The system of claim 4, wherein the high pressure pump is driven by a rear gear assembly.

11. The system of claim 4, wherein the controller is an ECM or a microprocessor.

12. A hydraulically-operated electronically controlled fuel injector system for an internal combustion engine for actuating a fuel injector, the system comprising:

a controller able to receive an actuating fluid pressure measurement from an ICP sensor;

an IPR valve;

an internal high pressure oil circuit comprising at least one high pressure oil reservoir, a high pressure pump disposed in a high pressure puma housing and operatively connected to the integrated low pressure oil reservoir, and an internally disposed high pressure oil line operatively connected to the high pressure pump and the at least one high pressure oil reservoir; wherein the high pressure pump housing comprises a high pressure pump cover and a high pressure pump mounting in a first area of a crank case; and a low pressure oil circuit comprising an integrated oil reservoir;

wherein the controller selectively modifies pressure in the high pressure oil circuit via selective actuation of the IPR valve to obtain a desired pressure in the high pressure oil circuit.

13. The system of claim 12, wherein the high first area of the crank case is a rear top crank case area.

14. The system of claim 13, wherein the Integrated low pressure fluid reservoir comprises:

a low pressure fluid cooler; and a low pressure fluid housing in a front top crank case area.

15. The system of claim 14, wherein the high pressure pump housing and the integrated low pressure oil reservoirs are disposed between a first and a second cylinder head.

16. The system of claim 15, wherein the high pressure oil line comprises:

a high pressure discharge tube attached to the high pressure pump;

a branch tube section attached to the high pressure discharge tube;

a rigid tube section attached to the branch tube section;

a flexible tube section attached to the rigid tube section;

a high pressure check valve attached between the flexible tube section and the high pressure actuating oil reservoir.

17. The system of claim 16, wherein the integrated low pressure oil reservoir further comprises:

a high pressure pump filter; and a high pressure pump feed passage connected to the high pressure pump.

18. The system of claim 15, wherein the high pressure pump feed passage is in the crank case and is comprised of a horizontal low pressure fluid passage connecting to a vertical pump inlet passage.

19. The system of claim 18, wherein the high pressure pump cover comprises:

an IPR valve mounting configured to accept the IPR valve;

an ICP mounting able to accept the ICP sensor; and a pump cover fluid passage cooperatively attached to the high pressure oil line and connected to the IPR valve mounting and the ICP mounting.

20. The system of claim 19, wherein the high pressure discharge tube comprises:

an IPR valve tube section, and a high pressure discharge tube section;

and wherein the branch discharge tube comprises a branch section, a first branch attached to the branch section at a first branch end, a first branch coupler attached to a first branch distal end and able to receive a first rigid tube section, a second branch attached to the branch section at a second branch end, a second branch coupler attached to a second branch distal end and able to receive a second rigid tube section.

21. The system of claim 13, wherein the high pressure pump is driven by a rear gear assembly.

22. A high pressure oil circuit for use in an internal combustion engine for actuating a fuel injector, the high pressure oil circuit comprising:

an ICP sensor;

an IPR valve;

at least one high pressure oil reservoir;

a high pressure pump housing comprising a high pressure pump cover and a high pressure pump mounting in a rear top crank case area;

a high pressure pump disposed in the high pressure pump housing and operatively connected to an integrated low pressure oil reservoir;

an internally disposed high pressure oil line operatively connected to the high pressure pump and the at least one high pressure oil reservoir;

wherein a controller selectively modifies pressure in the high pressure oil circuit via selective actuation of the IPR valve to obtain a desired pressure in the high pressure oil circuit.

23. The high pressure oil circuit of claim 22, wherein the high pressure pump housing is disposed between a first and a second cylinder head.

24. The high pressure oil circuit of claim 23; wherein the high pressure pump is driven by a rear gear assembly.

25. The high pressure oil circuit of claim 24, wherein the internal high pressure oil line comprises:

a high pressure discharge tube attached to the high pressure pump;

a branch tube section attached to the high pressure discharge tube;

a rigid tube section attached to the branch tube section;

a flexible tube section attached to the rigid tube section;

a high pressure check valve attached between the flexible tube section and the high pressure actuating oil reservoir.

26. The high pressure oil circuit of claim 25 wherein the integrated low pressure oil reservoir comprises:

a low pressure oil cooler; and a low pressure oil housing in a front top crank case area.

27. An integrated tow pressure oil reservoir for use in a hydraulically-operated electronically controlled fuel Injector system for an internal combustion engine for actuating a fuel injector, the oil reservoir comprising:

a low pressure oil cooler;

a low pressure oil housing in a front top crank case area;

a high pressure pump filter; and a high pressure pump feed passage.

28. The integrated low pressure oil reservoir of claim 27, wherein the high pressure pump feed passage is in the crank case and is comprised of a horizontal low pressure fluid passage connecting to a vertical pump inlet passage.

29. A hydraulically-operated electronically controlled unit fuel injector system for an internal combustion engine having at least one fuel injector, a controller, an injection control pressure sensor, an injection pressure regulator valve, a high pressure check valve, and at least one high pressure oil reservoir, the improvement comprising:

an integrated low pressure oil reservoir;

a high pressure pump housing comprising a high pressure pump cover and a high pressure pump mounting in a rear top crank case area;

a high pressure pump disposed in the high pressure pump housing and operatively connected to the integrated low pressure oil reservoir;

an internally disposed high pressure oil line operatively connected to the high pressure pump and the at least one high pressure oil reservoir;

wherein the controller selectively modifies pressure in the high pressure oil circuit via selective actuation of the IPR valve to obtain a desired pressure in the high pressure oil reservoir and thereby allow an actuated fuel injector to deliver fuel.

30. The improvement of claim 29 wherein the high pressure pump housing is disposed between a first and a second cylinder head.

31. The improvement of claim 30, wherein the high pressure pump is driven by a rear gear assembly.

32. The improvement of claim 31 wherein the internal high pressure oil line comprises:

a high pressure discharge tube attached to the high pressure pump;

a branch tube section attached to the high pressure discharge tube;

a rigid tube section attached to the branch tube section;

a flexible tube section attached to the rigid tube section.

33. The improvement of claim 32, wherein the integrated low pressure the oil reservoir comprises:

a low pressure oil cooler;

a low pressure oil housing in a front top crank case area;

a high pressure pump filter; and a high pressure pump feed passage.

34. The improvement of claim 33, wherein the high pressure pump feed passage is in the crank case and is comprised of a horizontal low pressure fluid passage connecting to a vertical pump inlet passage.

35. The improvement of claim 34, wherein the internal combustion engine is a gasoline or diesel engine.

* * * * *